US008070052B2

(12) United States Patent
Spivey, Sr. et al.

(10) Patent No.: US 8,070,052 B2
(45) Date of Patent: Dec. 6, 2011

(54) CARTON WITH HANDLE

(75) Inventors: Raymond R. Spivey, Sr., Mableton, GA (US); Leonard M. Cooper, Powder Springs, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 198 days.

(21) Appl. No.: 12/407,357

(22) Filed: Mar. 19, 2009

(65) Prior Publication Data

US 2009/0236408 A1 Sep. 24, 2009

Related U.S. Application Data

(60) Provisional application No. 61/037,875, filed on Mar. 19, 2008.

(51) Int. Cl.
*B65D 5/468* (2006.01)

(52) U.S. Cl. ..... 229/117.13; 229/920

(58) Field of Classification Search ..... 229/117.12, 229/117.13, 117.14, 920; 206/140, 141, 206/427

See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |
| 2,702,144 | A | 2/1955 | Forrer |
| 2,797,856 | A | 7/1957 | Jaeschke |
| 2,810,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,127,720 | A | 4/1964 | Gentry et al. |
| 3,204,815 | A | 9/1965 | Weiss |
| 3,309,005 | A | 3/1967 | Pilger |
| 3,334,767 | A | 8/1967 | Cornelius et al. |

(Continued)

FOREIGN PATENT DOCUMENTS

| | | |
|---|---|---|
| CA | 877792 | 8/1971 |

(Continued)

OTHER PUBLICATIONS

PCT/US2009/037642—International Search Report and Written Opinion, Mar. 19, 2009.

(Continued)

*Primary Examiner* — Gary Elkins
(74) *Attorney, Agent, or Firm* — Womble Carlyle Sandridge & Rice, LLP

(57) ABSTRACT

A carton for containing a plurality of articles. The carton comprises a first top panel, a second top panel, a bottom panel, a first side panel, and a second side panel. The first top panel and the second top panel being at least partially overlapped to form a top wall of the carton. At least two end flaps are overlapped with respect to one another and thereby at least partially form a closed end of the carton. A handle in the top wall of the carton comprises a first handle section in the first top panel, a second handle section in the second top panel, and a handle reinforcement flap foldably connected to at least one of the first top panel and the second top panel. The first handle section, the second handle section, and the handle reinforcement flap are placed in overlapping relationship to form the handle.

23 Claims, 8 Drawing Sheets

U.S. PATENT DOCUMENTS 3,355,012 A 11/1967 Weiss
3,381,881 A 5/1968 Granz et al.
3,828,926 A 8/1974 Rossi
3,886,901 A 6/1975 Zeitler
3,904,036 A 9/1975 Forrer
3,933,303 A 1/1976 Kirby, Jr.
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,424,901 A 1/1984 Lanier
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,588,084 A 5/1986 Holley, Jr.
4,653,686 A 3/1987 Wood et al.
4,706,876 A 11/1987 Wilson
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,966,324 A 10/1990 Steel
5,020,337 A 6/1991 Krieg
5,060,792 A 10/1991 Oliff
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A * 5/1994 Stout et al. ..... 206/141
5,307,986 A 5/1994 Schuster
5,320,277 A * 6/1994 Stout et al. ..... 229/117.13
5,333,734 A 8/1994 Stout et al.
5,379,944 A * 1/1995 Stout et al. ..... 229/117.13
5,381,891 A 1/1995 Harris
5,385,234 A * 1/1995 Stout et al. ..... 206/427
5,395,044 A 3/1995 Stout
5,427,241 A 6/1995 Sutherland
5,458,234 A 10/1995 Harris
5,472,090 A 12/1995 Sutherland
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 * 10/2001 Stout ..... 229/117.13
D452,154 S 12/2001 Rhodes et al.
6,425,520 B1 7/2002 Peterson
6,523,739 B2 2/2003 Heeley et al.
6,631,803 B2 10/2003 Rhodes et al.
6,758,337 B2 7/2004 Chargueraud et al.
6,834,793 B2 12/2004 Sutherland
6,848,573 B2 2/2005 Gould et al.
6,869,009 B2 3/2005 Sutherland et al.
6,905,066 B2 6/2005 Holley et al.
6,926,193 B2 8/2005 Smalley
6,945,450 B2 9/2005 Rusnock
7,234,596 B2 6/2007 Lebras
7,296,731 B2 11/2007 Auclair et al.
7,380,701 B2 6/2008 Fogle et al.
7,416,109 B2 8/2008 Sutherland
7,427,010 B2 9/2008 Sutherland
7,472,791 B2 1/2009 Spivey, Sr.
7,601,111 B2 10/2009 Sutherland et al.
7,699,215 B2 4/2010 Spivey, Sr.
7,743,944 B2 6/2010 Ho Fung et al.
7,748,603 B2 7/2010 Fogle et al.
7,757,933 B2 7/2010 Dunn
7,806,314 B2 10/2010 Sutherland
2003/0213263 A1 11/2003 Woog
2004/0074954 A1 4/2004 Fogle et al.
2005/0056658 A1 3/2005 Spivey
2005/0167478 A1 8/2005 Holley, Jr.
2006/0071058 A1 4/2006 Spivey, Sr.
2006/0169755 A1 8/2006 Spivey, Sr.
2006/0273143 A1 12/2006 Finch
2007/0039846 A1 * 2/2007 Spivey, Sr. ..... 206/427
2007/0051781 A1 3/2007 Holley, Jr.
2007/0108261 A1 5/2007 Schuster
2007/0164091 A1 7/2007 Fogle et al.
2007/0181658 A1 8/2007 Sutherland
2007/0205255 A1 9/2007 Dunn
2007/0284424 A1 12/2007 Holley
2007/0295789 A1 12/2007 Ho Fung
2008/0083820 A1 4/2008 Walling et al.
2008/0119344 A1 5/2008 Sutherland et al.
2009/0236408 A1 9/2009 Spivey, Sr.
2009/0255983 A1 10/2009 De Paula et al.
2010/0213249 A1 8/2010 Requena

FOREIGN PATENT DOCUMENTS

CA 2 160 145 9/1995
DE 85 14 718.4 6/1985
DE 296 07 374 U1 4/1996
DE 201 12 228 11/2002
DE 2004 018 649 4/2005
EP 0412226 A1 2/1991
EP 0473 266 3/1992
EP 1 612 157 1/2006
FR 1 494 239 9/1967
FR 2 579 175 9/1986
KR 20-0356729 7/2004
WO WO/96/27538 9/1996
WO WO 99/28207 6/1999
WO WO/00/78618 12/2000
WO WO/01/66434 9/2001
WO WO 03/037742 A2 5/2003

| | | |
|---|---|---|
| WO | WO/2005/080218 | 9/2005 |
| WO | WO/2005/123532 | 12/2005 |
| WO | WO/2007/089282 | 8/2007 |

OTHER PUBLICATIONS

International Search Report for PCT application No. PCT/US2010/025178, mailed Sep. 2, 2010.
Written Opinion for PCT application No. PCT/US US2010/025178, mailed Sep. 2, 2010.
PCT/US2009/037642—International Search Report and Written Opinion Mar. 19, 2009.
International Search Report for PCT application No. PCT/US2010/025177, mailed Sep. 2, 2010.
Written Opinion for PCT application No. PCT/US US2010/025177, mailed Sep. 2, 2010.
PCT/US2009/040424—International Search Report and Written Opinion.

* cited by examiner

CARTON WITH HANDLE

CROSS-REFERENCE TO RELATED APPLICATIONS

This application claims the benefit of U.S. Provisional Application No. 61/037,875 which was filed on Mar. 19, 2008. The entire content of the above-referenced provisional application is hereby incorporated by reference as if presented herein in its entirety.

BACKGROUND OF THE DISCLOSURE

The present disclosure generally relates to cartons for holding and dispensing beverage containers or other types of articles. More specifically, the present invention relates to cartons having a reinforced handle.

SUMMARY OF THE DISCLOSURE

In general, one aspect of the invention is directed to a carton for containing a plurality of articles. The carton comprises a plurality of panels that extends at least partially around an interior of the carton. The plurality of panels comprises a first top panel, a second top panel, a bottom panel, a first side panel, and a second side panel. The first top panel and the second top panel being at least partially overlapped to form a top wall of the carton. At least two end flaps respectively foldably attached to respective panels of the plurality of panels, wherein the end flaps are overlapped with respect to one another and thereby at least partially form a closed end of the carton. A handle in the top wall of the carton comprises a first handle section in the first top panel, a second handle section in the second top panel, and a handle reinforcement flap foldably connected to at least one of the first top panel and the second top panel. The first handle section, the second handle section, and the handle reinforcement flap are placed in overlapping relationship to form the handle.

In another aspect, the disclosure is generally directed to a blank for forming a carton. The blank comprises a plurality of panels comprising a first top panel, a second top panel, a bottom panel, a first side panel, and a second side panel. At least two end flaps are respectively foldably attached to respective panels of the plurality of panels. The blank comprises features in the first top panel and the second top panel, wherein the features are for cooperating to at least partially define a handle in a carton erected from the blank. The features comprise a first handle section in the first top panel, a second handle section in the second top panel, and a handle reinforcement flap foldably connected to at least one of the first top panel and the second top panel.

In another aspect, the disclosure is generally directed to a method of assembling a carton. The method comprises providing a blank comprising a plurality of panels comprising a first top panel, a second top panel, a bottom panel, a first side panel, and a second side panel. The first top panel and the second top panel are at least partially overlapped to form a top wall of the carton. At least two end flaps are respectively foldably attached to respective panels of the plurality of panels. The first top panel comprises a first handle section. The second top panel comprises a second handle section. A handle reinforcement flap is foldably connected to at least one of the first top panel and the second top panel. The method further comprises forming a top wall of the carton by at least partially overlapping the first top panel and the second top panel. The forming the top wall comprises forming a handle in the top wall by at least partially positioning the first handle section, the second handle section, and the handle reinforcement flap in an overlapping relationship to form the handle.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
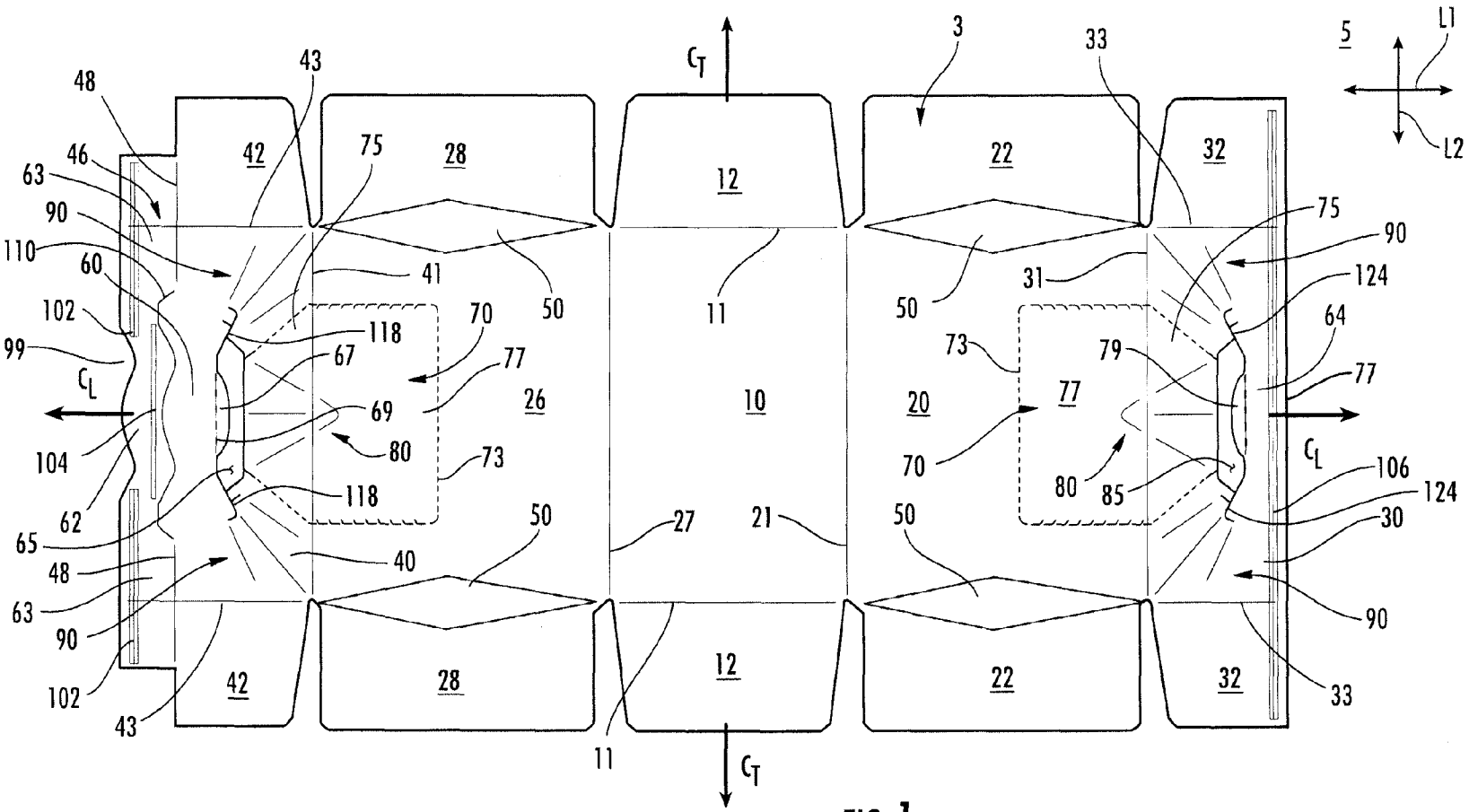
FIG. 1 is a plan view of an exterior surface of a blank used to form a carton according to a first embodiment of the present disclosure.

FIG. 1 is a plan view of the exterior side 3 of a blank 5 used to form a carton 150 (FIGS. 4-8) according to a first exemplary embodiment of the disclosure. The carton 150 can be used to house a plurality of articles such as containers C (FIG. 8). In the illustrated embodiment, the carton 150 has two dispensers, generally indicated at 7 (FIG. 5), formed in the carton for allowing access to the containers C. In the illustrated embodiment, the carton 150 is sized to house twenty-four containers C in two layers in a 3×4×2 arrangement, but it is understood that the carton may be sized and shaped to hold containers of a different or same quantity in more than or less than two layers and/or in different row/column arrangements (e.g., 3×5×2, 3×6, 2×6×2, 3×5, 2×9, 2×6, 3×4, etc.). In the illustrated embodiments, the containers C are twelve ounce generally cylindrical beverage cans. Other container types, as well as other articles, may also be accommodated in cartons constructed according to the present invention. In the illustrated embodiment, the carton 150 includes a handle, generally indicated at 160 for grasping and carrying the carton. As will be discussed below in more detail, the handle 160 is formed from various features in the blank 5.

The blank 5 has a longitudinal axis L1 and a lateral axis L2. In the embodiment of FIG. 1, the blank 5 has at least partial symmetry about a longitudinal center line $C_L$ and about a transverse center line $C_T$. Therefore, certain elements in the drawing figures have similar or identical reference numerals in order to reflect the whole and/or partial longitudinal and transverse symmetries of the blank 5.

Referring to FIG. 1, the blank 5 comprises a bottom panel 10 foldably connected to a first side panel 20 at a first lateral fold line 21. A second side panel 26 is foldably connected to the bottom panel at a second lateral fold line 27. A first top panel 30 is foldably connected to the first side panel 20 at a third lateral fold line 31. A second top panel 40 is foldably connected to the second side panel 26 at a fourth lateral fold line 41.

The bottom panel 10 is foldably connected to first and second bottom end flaps 12. The first side panel 20 is foldably connected to a first and second side end flap 22. The second side panel 26 is foldably connected to a first and second side end flap 28. The first top panel 30 is foldably connected to a first and second top end flap 32. The second top panel 40 is foldably connected to a first and second top end flap 42. When the carton 150 is erected, the top and bottom end flaps 12, 32, 42 and side end flaps 22, 28 at a first end of the blank 5 close a first end 51 of the carton, and the top and bottom end flaps and side end flaps at a second end of the blank close a second 53 end of the carton. In accordance with an alternative embodiment of the present invention, different flap arrangements can be used for closing the ends of the carton 150.

In the illustrated embodiment, the bottom end flaps 12 are foldably connected to opposite ends of the bottom panel 10 at longitudinal fold lines 11. The side end flaps 22, 28 are connected at each end of each of the first and second side panel 20, 26 at the diamond-shaped corner panels 50. The first top end flaps 32 are connected to each end of the first top panel 30 at longitudinal fold lines 33. The second top end flaps 42 are connected to each end of the second top panel 40 at longitudinal fold lines 43. The longitudinal fold lines 11, 33, 43 may be, for example, substantially straight, or offset at one or more locations to account for blank thickness or for other factors.

In one embodiment, the blank 5 includes a first dispenser panel 70 that is formed by a first tear line 73. The first dispenser panel 70 has a first portion 75 in first top panel 30 and a second portion 77 in the first side panel 20. A second dispenser panel 70 is similarly shaped as the first dispenser panel, but is formed in the second top panel 40 and the second side panel 26. One or both of the dispenser panels 70 could be omitted from the blank 5 without departing from the disclosure. Further, one or both of the dispenser panels 70 could be otherwise shaped, arranged, and/or configured without departing from the disclosure.

A plurality of stress-diverting score lines 80 are formed in the dispenser panel 70. A plurality of stress-diverting score lines 90 are formed in the first and second top panels 30 and 40. In the illustrated embodiment, the stress-diverting score lines 80, 90 are formed in groups of three adjacent score lines. The score lines 80, 90 of each group are oblique lines. The score lines 90 in the first and second top panel 30, 40 diverge as the score lines extend radially outward from a central portion of the top panel. The score lines 80 in the dispenser panel converge as the score lines extend radially outward from a central portion of the top panel to a respective lateral fold line 31, 41. The stress-diverting score lines 80 and 90 increase the carrying capacity of the carton 150 by distributing stress as the carton 150 is lifted by its handle 160, shown in FIGS. 2-7.

Figure 6:
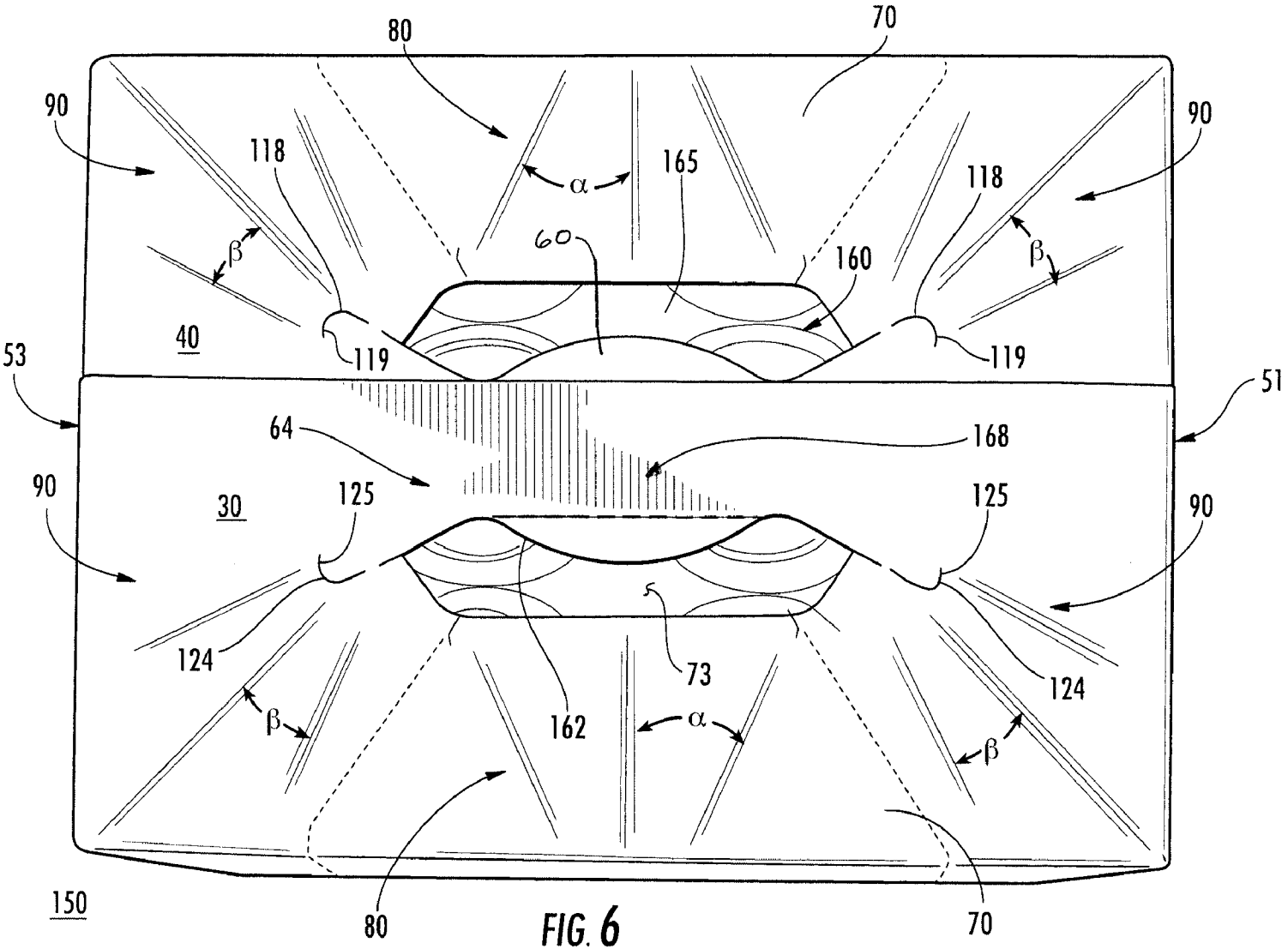
FIG. 6 is a top view of the carton.

The stress-diverting score lines 80 and 90 are grouped in plural sets of non-parallel lines. There are two sets of score lines 80 and four sets of score lines 90, as shown in FIGS. 1 and 6. Each set of score lines 80 are fully contained within a dispenser panel 70. Each set of these score lines 80 include a group of three non-parallel lines on each top panel 30 and 40 that converge toward at least one curved score line in a side panel 20, 26. These three non-parallel lines have substantially the same length and are spaced apart by substantially equal angles $\alpha$, preferably less than about twenty degrees. The outer score lines of the three non-parallel lines of each set of score lines 80 are adjacent to and in alignment with ends of a curved score line and the side panel 20. Each set of score lines 90 includes a group of three non-parallel lines. These non-parallel lines are spaced apart by substantially equal angles $\beta$, preferably less than about twenty degrees. The center line of each set of score lines 90 is directed toward a corner of the carton 150 and has a substantially greater length than the outer two score lines of each set. The score lines 80, 90 could be otherwise shaped, arranged, and/or positioned, or the score lines could be omitted, without departing from the disclosure.

In the illustrated embodiment, a handle reinforcement flap 46 is foldably connected to the second top panel 40 and the top end flaps 42 at lateral fold lines 48. The handle reinforcement flap 46 is removably attached to the second top panel 40 at a tear line 110 that extends between the lateral fold lines 48. Alternatively, the tear line 110 could be a cut line or other line of weakening that allows separation of the reinforcement flap 46 from the second top panel 40. The handle reinforcement flap 46 has a reinforcement handle section 62 defined by the portion of the handle reinforcement flap between a lateral edge 49 of the blank 5 and the tear line 110. The handle reinforcement flap 46 includes respective reinforcement end portions 63 at respective ends of the reinforcement handle section 62. Each of the reinforcement end portions 63 is foldably connected to the second top panel 40 and one of the end panels 42 at the lateral fold lines 48. The handle reinforcement flap 46 could be otherwise shaped, arranged, and/or configured without departing from the disclosure.

The second top panel 40 has a second handle section 60 formed in a central portion of the second top panel. The second handle section 60 is adjacent the reinforcement handle section 62 and an opening 65 in the second top panel. The second handle section is partially define by respective cuts 118 that extend from the opening 65 into the second top panel 40. The second handle section 60 includes a comfort panel 67 adjacent the opening 65. The comfort panel 60 is foldably connected to the second handle section 60 at a lateral fold line 69. The second handle section 60 could be otherwise shaped, arranged, and configured without departing from the disclosure.

The first top panel 30 has a first handle section 64 that is similar in shape as the second handle section 60 and an opening 85. The first handle section 64 is at least partially defined by the space between the opening 85 and tear lines 124 on one side of the first handle section and the lateral edge 77 of the blank 5 on the other side of the first handle section. The first handle section 64 has a comfort panel 79 adjacent the opening 85. The first handle section 64 could be otherwise shaped, arranged, and/or configured without departing from the disclosure. The handle sections 60, 62 and 64 overlap in the erected carton to form a multi-ply carton handle 160, as shown in FIGS. 4-8.

Still referring to FIG. 1, adhesives 102, 104 and 106, which may be in the form of glue strips, for example, may be applied to the surface of the blank 5 to facilitate erection of the carton 150. The adhesives 102, 104 and 106 illustrated in FIG. 1 are applied to the interior surface of the blank 5, although other arrangements and adhesive forms are possible.

Figure 2:
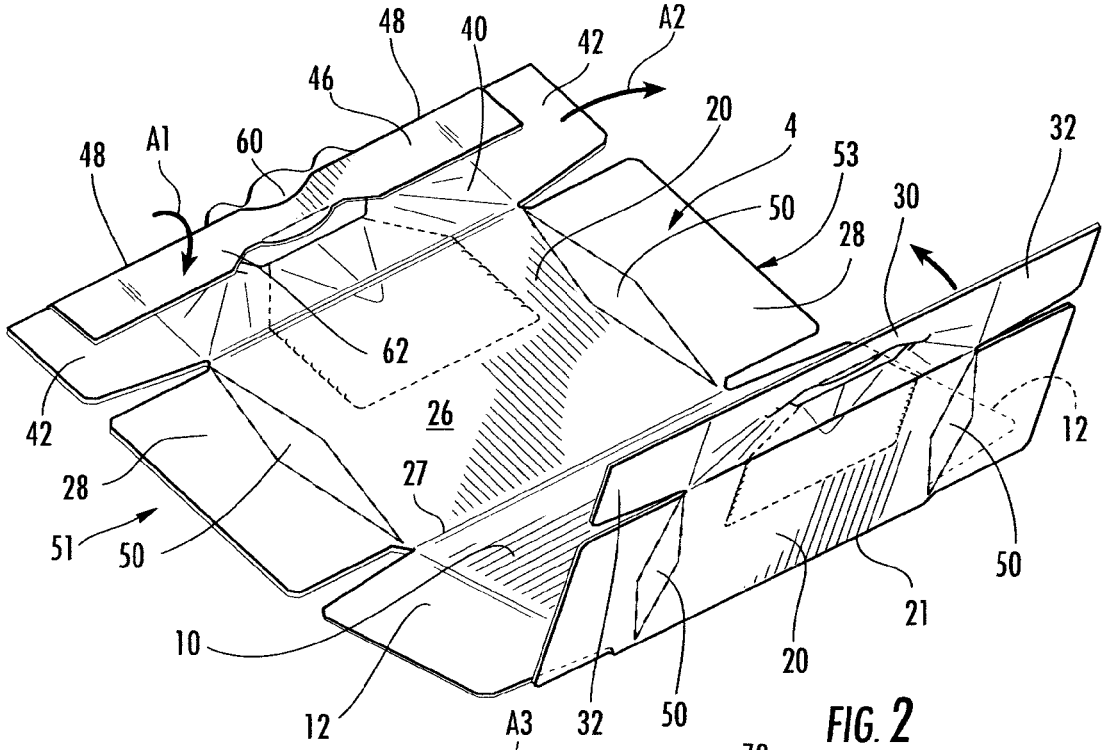
FIG. 2 is a view of an interior surface of the blank of FIG. 1 formed into a partially assembled condition.

In accordance with an exemplary embodiment, a method of forming the carton 150 from the blank 5 will now be described with reference to FIGS. 1-4. As shown in FIG. 2, the blank 5 is positioned with an interior surface 4 facing upward. The handle reinforcement flap 46 is folded about fold lines 48 in the direction of arrow A1. The handle reinforcement flap 46 is placed in face-to-face contact with the second top panel 40 and the end flaps 42. The reinforcement handle section 62 is adhesively connected to the second handle section 60 by adhesive strip 104. The reinforcement end portions 63 are adhesively connected to the second top panel 40 and the end flaps 42 by the adhesive strips 102. Also, the side panels 20, 26 are folded upwardly about fold lines 21, 27 relative to the bottom panel 10 and generally in the direction of arrows A2.

Figure 3:
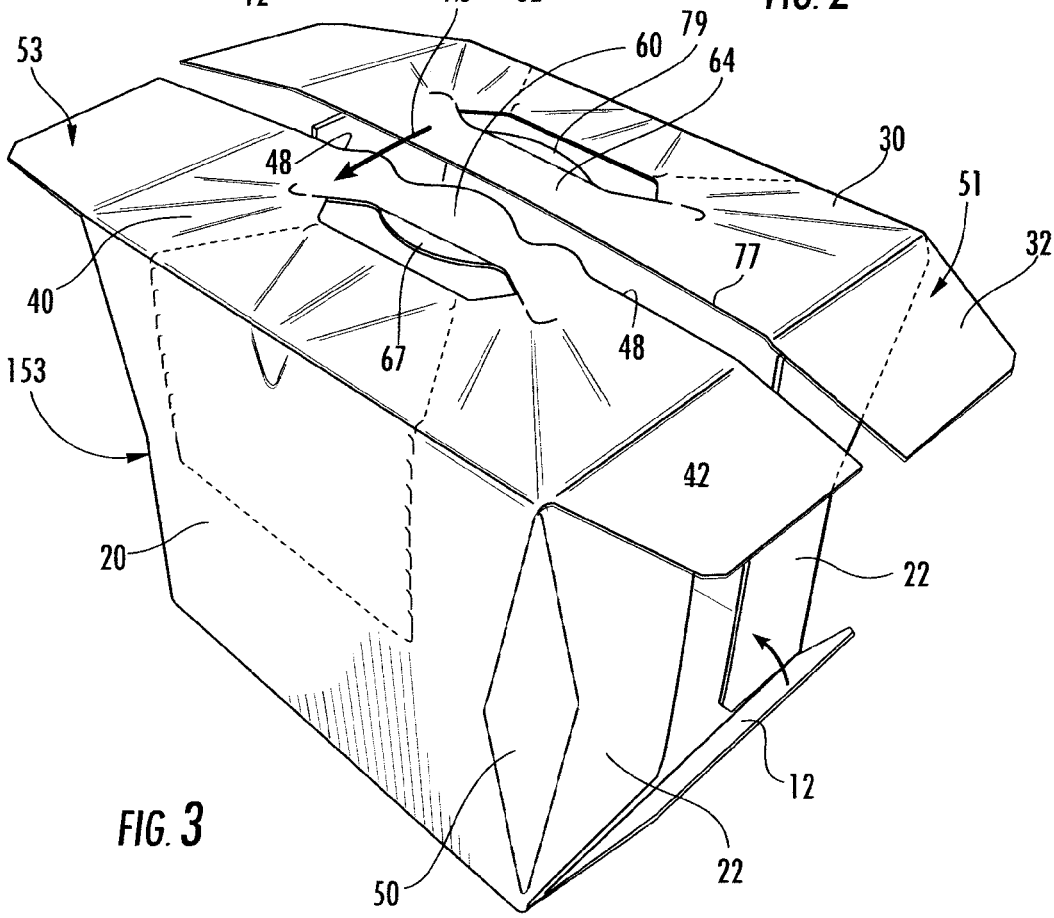
FIG. 3 is a perspective of the carton in a further partially assembled condition.
Figure 4:
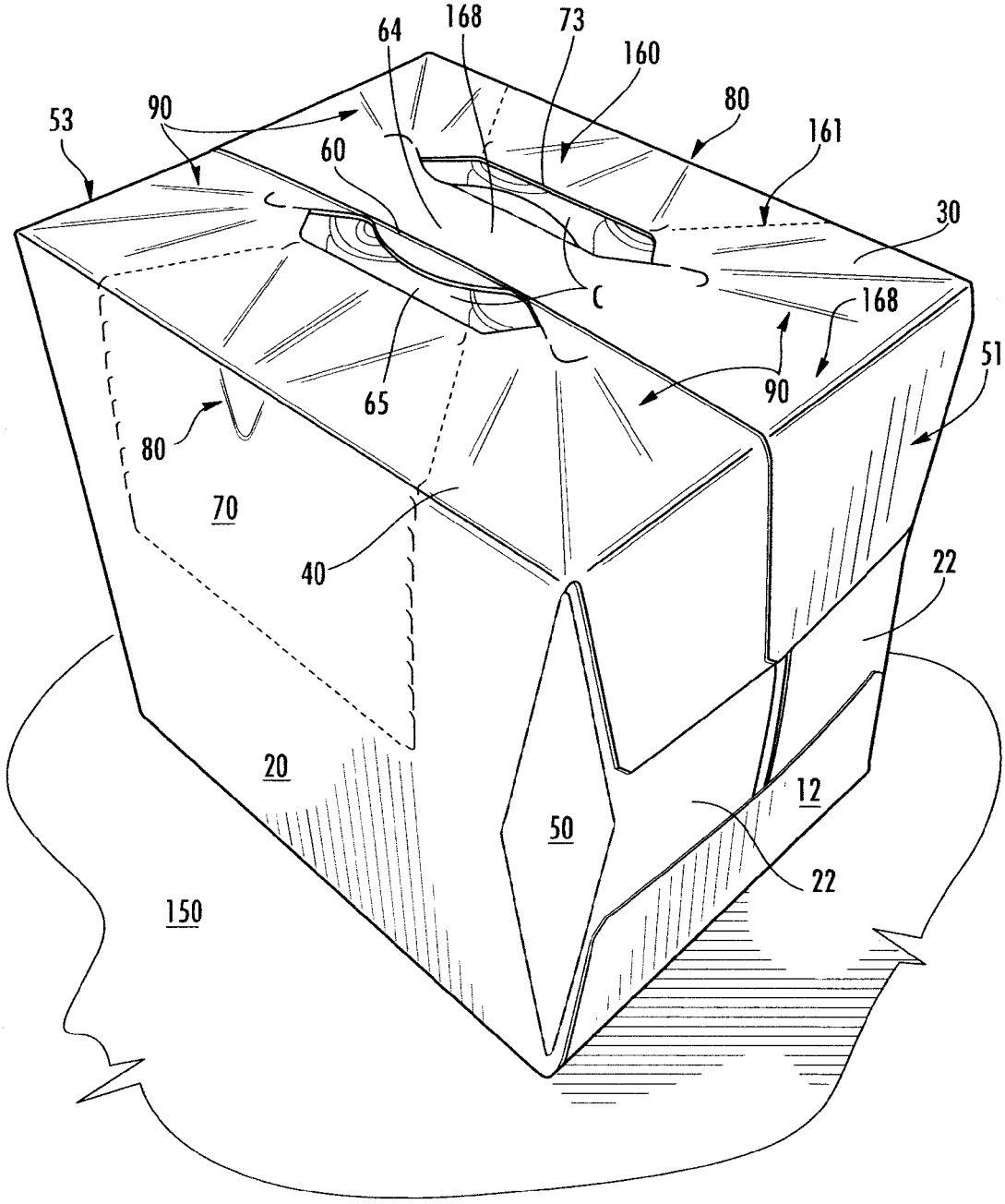
FIG. 4 is side perspective view of the carton.

As shown in FIG. 3, the first top panel 30 is positioned in the direction of arrow A3 to partially overlap the second top panel 40 and form the top wall 161 of the carton 150. The first handle section 64 is placed in face-to-face contact with the second handle section 62 and they are adhesively secured by the adhesive strip 106. In this manner the reinforcement handle section 62 that is secured to the second handle section 60 and the first handle section 64 that is secured to the second handle section 60 form the multi-ply handle 160. Securing the first top panel 30 to the second top panel 40 forms a generally open-ended sleeve 153 (FIG. 3).

In the illustrated embodiment, one end of the sleeve 153 is closed by respectively overlapping and adhering the side end flaps 22, 28 and the top and bottom end flaps 12, 32, 42 at one end of the sleeve after the containers C are inserted into the carton. The second end of the sleeve is closed by respectively overlapping and adhering the side end flaps 22, 28 and top and bottom end flaps 12, 32, 42 at the second end of the sleeve. Once the blank 5 is formed into the sleeve 153, the containers C may be loaded in the carton 150 from either end and then the ends may be closed. Alternative loading and closing steps may be used without departing from the scope of this invention.

The overlapping handle sections 60, 62 and 64 form the multi-ply handle 160 in the top wall 161 of the carton 150 for grasping and carrying the carton. The elongate structure of the handle 160 acts to distribute the stresses of lifting along a greater surface of the paperboard forming the top of the carton 150. Openings 65, 85 on either side of the handle 160 also provide a convenient starting point for initiating opening of the dispenser sections 70. In the illustrated embodiment, the handle 160 includes a three-ply section 168 that includes the overlapped handle sections 60, 62, 64 and the overlapped portions of the first top panel 30, second top panel 40, and reinforced end portions 63 of the handle reinforcement flap 46. The three ply section 168 extends across the length of the overlapped top panel 30, 40 and at least partially into the closed ends of the carton 150. In the closed ends of the carton 150, the three-ply section 168 includes overlapped top end flaps 32, 42 and the reinforced end portions 63 of the handle reinforcement flap. The three-play section 168 of the handle 160 could be otherwise shaped, arranged, and/or configured without departing from the disclosure.

The dispenser sections 70 are located primarily in the side panels 20, remote from areas of the top and ends of the carton comprising the overlapping handle sections 60, 62 and 64. This placement reduces the adverse effect of the score lines defining the perimeters of the dispenser sections 70 have on the strength of the handle 160.

Figure 5:
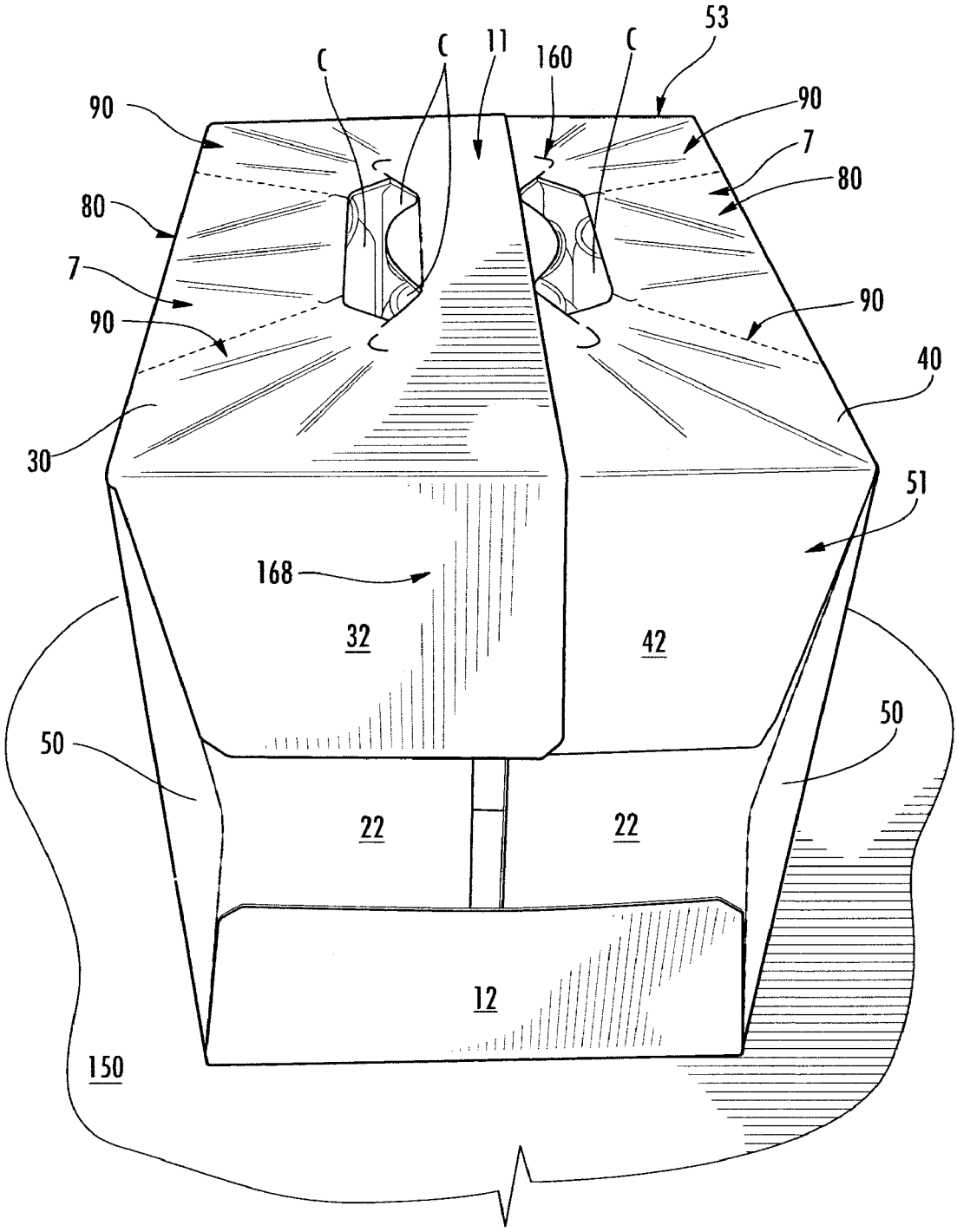
FIG. 5 is end perspective view of the carton.

FIG. 5 shows one end of the carton 150 and FIG. 6 shows the top of the carton 150. As shown in FIG. 6, the curved cuts 118 and 124 at the ends of the respective handle sections 60, 64 extend from a respective opening 65, 85 to an end portion 119, 125 that is positioned to extend inward toward the three-ply section 168 of the handle 160. Therefore, if the carton 150 tears at the ends of the handle sections 60, 62 and 64 during lifting by the handle 160, the tear will be directed inwardly toward the reinforced multi-ply section 168 of the handle 160.

Figure 7:
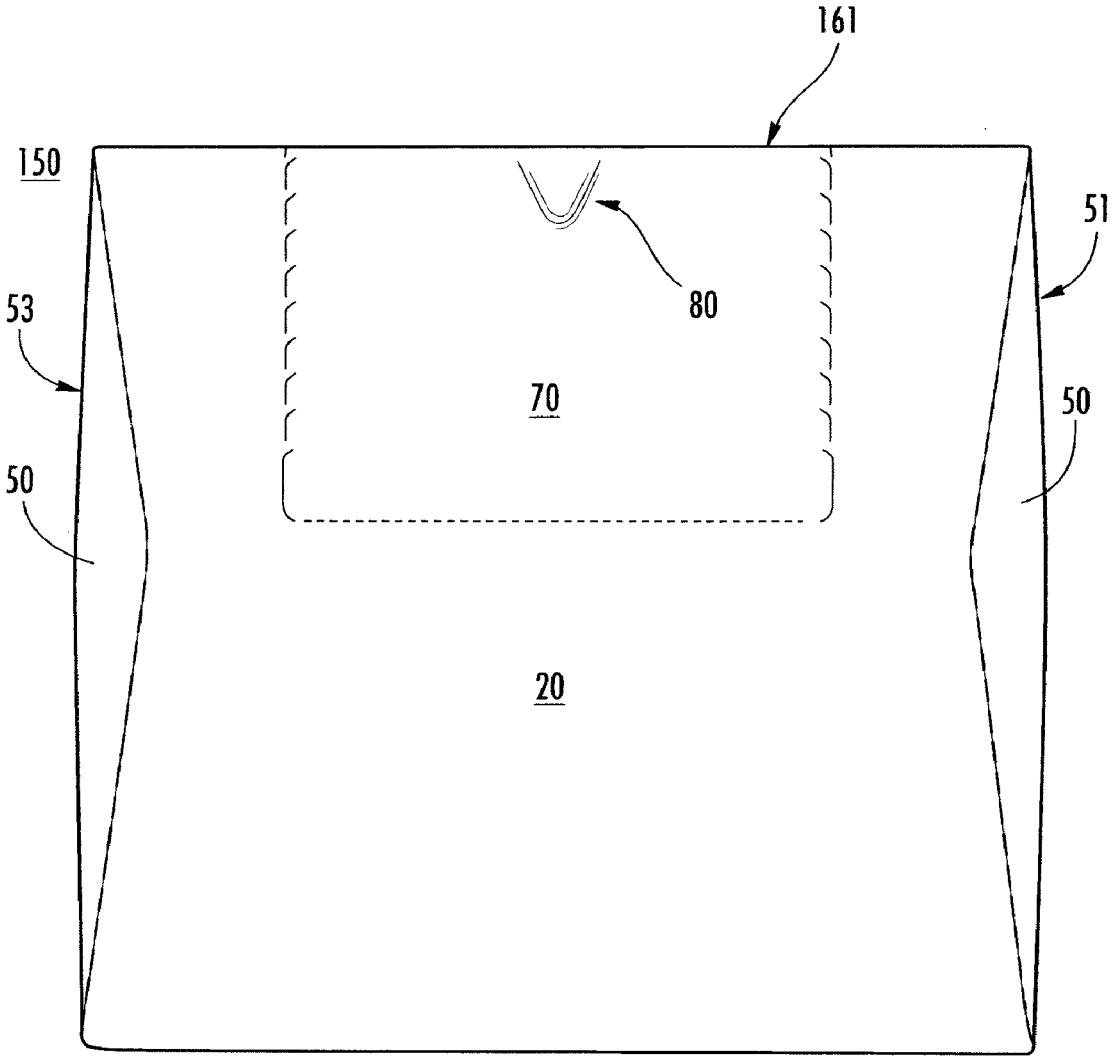
FIG. 7 is a side view of the carton.
Figure 8:
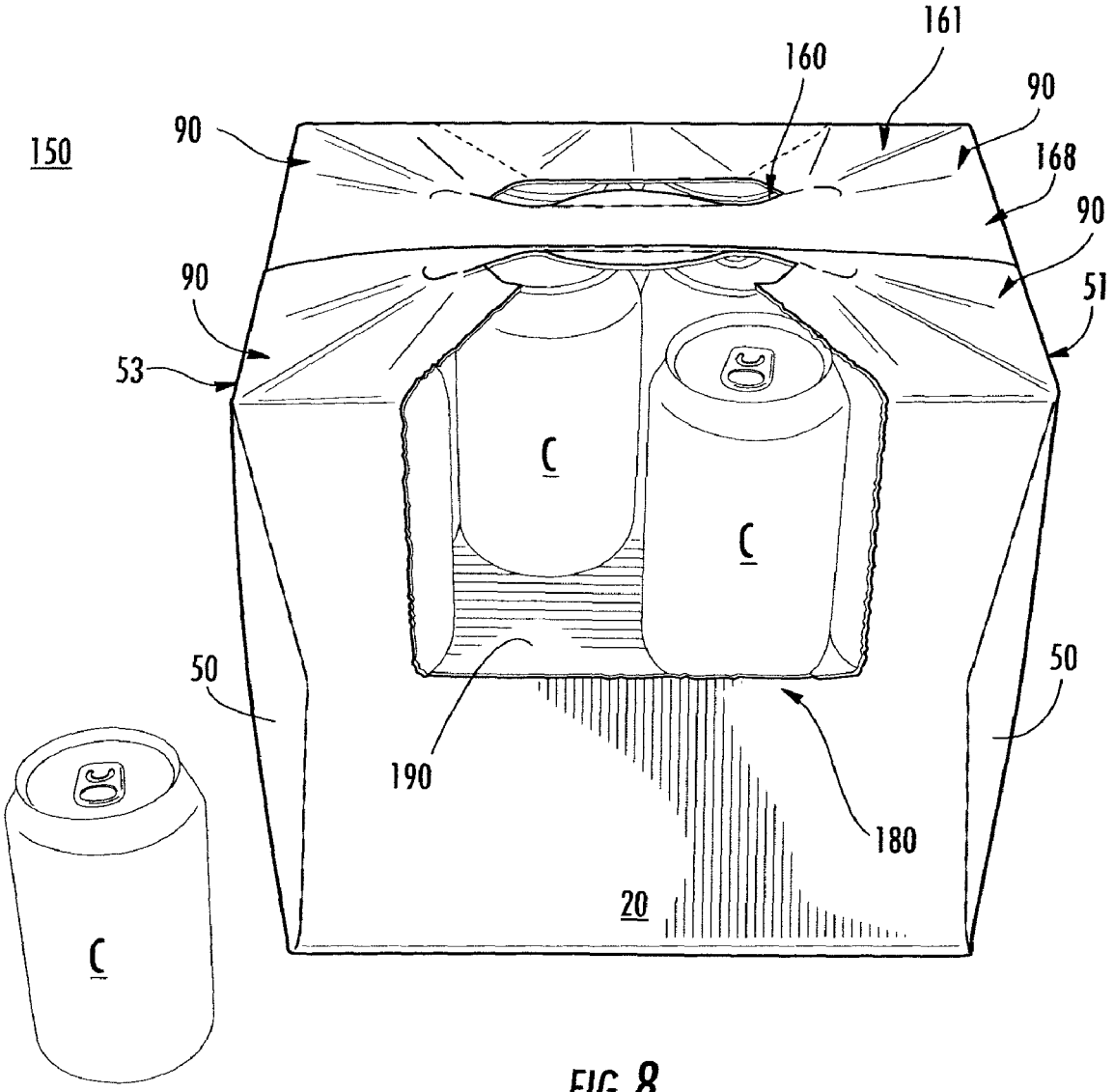
FIG. 8 is a side view of the carton with a dispenser opened and a container removed.

Referring to FIGS. 7 and 8, the carton 150 can be opened at one side by tearing the carton at tear line 73 to remove the dispenser panel 70. One or both of the dispenser panels 70 can be removed by grasping at a respective opening 65, 85 and tearing at tear line 73. Containers C in the carton interior can then be accessed through the resultant dispenser opening 180. The dispenser opening 180 includes portions of the side panels 20, 26 and portions of the top panels 30, 40. The dispenser opening 180 and dispenser panel 70 could be larger or smaller than illustrated and described herein. In the illustrated embodiment, the carton 150 accommodates twenty-four containers C in a 3×4×2 (three columns, four rows and two tiers) arrangement, although other container arrangements can be accommodated according to the principles of the present invention. As shown in FIG. 8, the upper tier of containers C rest on a separator pad 190. For example, the dispenser panel 70 and dispenser opening 180 could extend in the side panel 20, 26 to below the separator pad 190 so that containers C in the bottom tier can be accessed through the dispenser opening.

According to the above embodiment, the stress-diverting score lines 80 and 90 and the position and shape of the dispenser sections 70 provide increased strength to the handle 160. The elongate shape of the handle 160 further distributes lifting stress throughout the carton 150.

Figure 9:
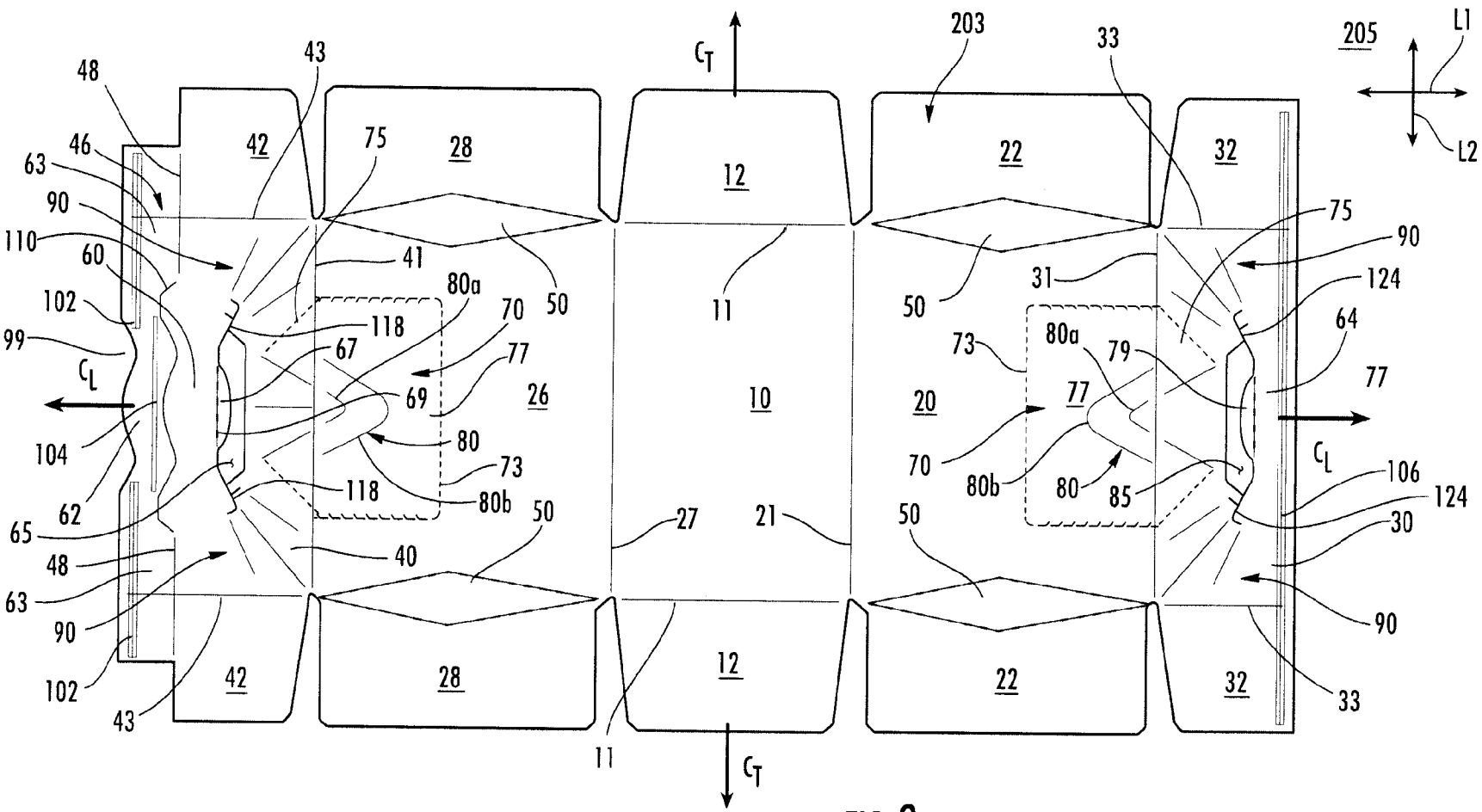
FIG. 9 is a plan view of an exterior surface of a blank used to form a carton according to a second embodiment of the present disclosure.

FIG. 9 shows an exterior surface 203 of a blank 205 used to form a carton (not shown) according to a second embodiment of the disclosure. The blank 205 has similar features as the blank 5 of the first embodiment. Accordingly, similar or identical features of the embodiments are provided with like or similar reference numbers. The blank 205 of the second embodiment includes two stress-diverting score lines 80*a*, 80*b* in each of the side panels 20, 26. In the illustrated embodiment, the score lines 80*a*, 80*b* are generally V-shaped and parallel. The score lines 80*a*, 80*b* are centered on the longitudinal centerline CL but the score lines could be otherwise shaped, arranged, and/or omitted. The blank 205 could have other features that are like or different than the first embodiment without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprises a first top panel, a second top panel, a bottom panel, a first side panel, and a second side panel, the first top panel and the second top panel being at least partially overlapped to form a top wall of the carton; and a handle in the top wall of the carton, the handle comprising a first handle section in the first top panel, a second handle section in the second top panel, and a handle reinforcement flap, the first handle section and the second handle section each respectively at least partially defining an opening and comprising a comfort panel adjacent the opening, the handle reinforcement flap being foldably connected to the second top panel by first and second fold lines that are spaced apart from one another, the handle reinforcement flap and the second handle section each respectively comprising a free edge defining a protrusion, and the first handle section, the second handle section, and the handle reinforcement flap being in overlapping relationship to form the handle such that the protrusion of the handle reinforcement flap is superposed with the comfort panel of the second handle section and the protrusion of the second handle section is superposed with the comfort panel of the first handle section.

2. The carton of claim 1 further comprising at least two end flaps respectively foldably attached to respective panels of the plurality of panels, wherein the end flaps are overlapped with respect to one another and thereby at least partially form a closed end of the carton, and wherein the at least two end flaps comprise at least one top end flap foldably connected to the second top panel, the handle reinforcement flap being foldably connected to the top end flap and comprising a reinforcement handle section.

3. The carton of claim 2 wherein the handle reinforcement flap is adhesively secured to the top end flap.

4. The carton of claim 2 wherein the handle reinforcement flap is in face-to-face contact with the interior surface of the second top panel, and the first top panel at least partially overlaps the exterior surface of the second top panel.

5. The carton of claim 4 wherein the first handle section is in face-to-face contact with the second handle section, and the second handle section is in face-to-face contact with the reinforcement handle section.

6. The carton of claim 1 further comprising a first plurality of stress-diverting score lines in the first top panel and a second plurality of stress-diverting score lines in the second top panel.

7. The carton of claim 6 wherein the first plurality of stress diverting score lines includes at least one group of oblique score lines.

8. The carton of claim 7 further comprising a dispenser for allowing access to the articles in the carton, the dispenser comprises a dispenser panel that is at least partially defined by a tear line in the carton and is for being at least partially removed for at least further opening a dispenser opening, the dispenser panel comprises a top portion comprising at least a portion of at least one of the first and second top panel, a side portion comprising at least a portion of at least one of the first and second side panel, and the side portion comprising at least one stress-diverting score line that is adjacent to the stress diverting score lines in the at least one of the first and second top panel.

9. The carton of claim 2 wherein:

the closed end is a first closed end;

the end flaps are first end flaps that are overlapped with respect to one another to form the first closed end, the top end flap is a first top end flap;

the carton further includes at least two second end flaps respectively foldably attached to respective panels of the plurality of panels, wherein the second end flaps are overlapped with respect to one another to form a second closed end of the carton, the at least two second end flaps comprising at least one second top end flap foldably connected to the second top panel; and the handle reinforcement flap comprises two reinforcement end portions respectively extending from the reinforcement handle section, each reinforcement end portion is in face-to-face contact with a portion of the second top panel and a respective one of the first top end flap and the second top end flap.

10. The carton of claim 1 wherein:

the free edge of the handle reinforcement flap comprises three curves; and the free edge of the second handle section comprises three curves.

11. The carton of claim 1 wherein:

the free edge of the handle reinforcement flap comprises an ogee curved portion; and the free edge of the second handle section comprises an ogee curved portion.

12. The carton of claim 2 wherein:

the closed end of the carton is a first end of the carton:

the carton includes a second end opposite the first closed end;

a central portion of the free edge of the handle reinforcement flap is positioned half way between the first and second ends of the carton; and a central portion of the free edge of the second handle section is positioned half way between the first and second ends of the carton.

13. The carton of claim 1, wherein a shape of the protrusion of the handle reinforcement flap is substantially similar to a shape of the comfort panel of the second handle section, and a shape of the protrusion of the second handle section is substantially similar to a shape of the comfort panel of the first handle section.

14. A blank for forming a carton comprising:

a plurality of panels comprising a first top panel, a second top panel, a bottom panel, a first side panel, and a second side panel;

at least two end flaps respectively foldably attached to respective panels of the plurality of panels;

features in the first top panel and the second top panel, wherein the features are for cooperating to at least partially define a handle in a carton erected from the blank, the features comprise a first handle section in the first top panel, a second handle section in the second top panel, and a handle reinforcement flap;

the second handle section having a length extending between opposite ends of the second handle section, and a width that extends crosswise to, and is smaller than, the length;

the handle reinforcement flap comprising a handle reinforcement section positioned between end portions of the handle reinforcement flap, and the end portions respectively being foldably connected to the second top panel by first and second fold lines that are spaced apart from one another; and a line for separation, for allowing an edge of the handle reinforcement section to be separated from an edge of the second handle section, the line for separation extending along substantially all of the length of the second handle section from an end of the first fold line to an end of the second fold line, wherein the line of separation is a tear line comprising three curves.

15. The blank of claim 14 wherein the at least two end flaps comprise first and second top end flaps foldably connected to the second top panel, the handle reinforcement flap being foldably connected to the first and second top end flaps.

16. The blank of claim 15 wherein:

the handle reinforcement flap is foldably connected to the first and second top end flaps by the first and second fold lines, respectively, and the line of separation is a cut line extending from the first fold line to the second fold line.

17. The blank of claim 16 wherein the cut line at least partially defines the reinforcement handle section and the second handle section.

18. The blank of claim 14 further comprising a first plurality of stress-diverting score lines in the first top panel and a second plurality of stress-diverting score lines in the second top panel, the first plurality of stress diverting score lines includes at least one group of oblique score lines.

19. The blank of claim 18 further comprising a dispenser panel that is at least partially defined by a tear line in the carton, the dispenser panel comprises a top portion comprising at least a portion of at least one of the first top panel and the second top panel, a side portion comprising at least a portion of at least one of the first side panel and the second side panel, and the side portion comprising at least one stress-diverting score line that is adjacent to the stress-diverting score lines in the at least one of the first and second top panel.

20. A method of assembling a carton from the blank of claim 14, the method comprising:

forming a top wall of the carton by at least partially overlapping the first top panel and the second top panel, the forming the top wall comprising forming a handle in the top wall by at least partially positioning the first handle section, the second handle section, and the handle reinforcement flap in an overlapping relationship to form the handle, comprising folding along the first and second fold lines, and separating the edge of the handle reinforcement section and the edge of the second handle section from one another along the line for separation.

21. The blank of claim 14 wherein:

the blank as a whole includes a periphery; and a central portion of the line of separation is positioned half way between opposite edges of the blank, the opposite edges being located at the periphery of the blank.

22. A blank for forming a carton comprising:

a plurality of panels comprising a first top panel, a second top panel, a bottom panel, a first side panel, and a second side panel;

features in the first top panel and the second top panel, wherein the features are for cooperating to at least partially define a handle in a carton erected from the blank, the features comprise a first handle section in the first top panel, a second handle section in the second top panel, and a handle reinforcement flap;

the first handle section and the second handle section each respectively at least partially defining an opening and comprising a comfort panel adjacent the opening, the handle reinforcement flap comprising a handle reinforcement section positioned between end portions of the handle reinforcement flap, and the end portions respectively being foldably connected to the second top panel by first and second fold lines that are spaced apart from one another; and a line for separation, for allowing an edge of the handle reinforcement section to be separated from an edge of the second handle section, the edge of the handle reinforcement flap and the edge of the second handle section each respectively comprising a protrusion defined by the line for separation, wherein the features are configured such that the protrusion of the handle reinforcement flap is for being superposed with the comfort panel of the second handle section and the protrusion of the second handle section is for being superposed with the comfort panel of the first handle section when the handle is assembled.

23. The blank of claim 22, wherein a shape of the protrusion of the handle reinforcement flap is substantially similar to a shape of the comfort panel of the second handle section, and a shape of the protrusion of the second handle section is substantially similar to a shape of the comfort panel of the first handle section.

* * * * *